United States Patent [19]

Hormadaly

[11] 4,362,656

[45] Dec. 7, 1982

[54] THICK FILM RESISTOR COMPOSITIONS

[75] Inventor: Jacob Hormadaly, Wilmington, Del.

[73] Assignee: E. I. Du Pont de Nemours and Company, Wilmington, Del.

[21] Appl. No.: 286,558

[22] Filed: Jul. 24, 1981

[51] Int. Cl.[3] ..... H01B 1/06

[52] U.S. Cl. ..... 252/518; 252/514; 252/521; 106/1.05; 427/126.2; 427/126.3; 427/126.5; 427/101; 338/308; 338/20; 428/432; 428/434; 29/610 R; 29/620

[58] Field of Search ..... 252/518, 521, 514; 106/1.24, 1.28, 1.15, 1.05, 47 R, 286.2, 54, 286.8; 338/308, 20, 307; 427/101, 102, 123, 126.5, 126.3, 126.2, 126.1; 428/432, 434, 901; 29/610 R, 620

[56] References Cited

U.S. PATENT DOCUMENTS

| | | | |
|---|---|---|---|
| 3,324,049 | 6/1967 | Holmes | 252/514 |
| 3,553,109 | 1/1971 | Hoffman | 252/514 |
| 3,583,931 | 6/1971 | Bouchard | 252/521 |
| 3,682,840 | 8/1972 | Van Loan | 252/518 |
| 3,868,334 | 2/1975 | Van Loan | 252/520 |
| 3,899,449 | 8/1975 | Pukaite | 252/518 |
| 4,175,061 | 11/1979 | Fujimara | 252/518 |
| 4,176,094 | 11/1979 | Horowitz et al. | 252/518 |
| 4,203,871 | 5/1980 | Horowitz et al. | 252/518 |
| 4,225,469 | 9/1980 | Horowitz et al. | 252/518 |
| 4,277,542 | 7/1981 | Boonstra et al. | 252/518 |

*Primary Examiner*—J. L. Barr

[57] ABSTRACT

Resistor composition comprising an admixture of finely divided particles of (a) ruthenium-based conductive material, (b) inorganic binder and (c) a manganese vanadate compound.

11 Claims, No Drawings

THICK FILM RESISTOR COMPOSITIONS

FIELD OF INVENTION

The invention is directed to compositions which are useful for making thick film resistors and particularly to such compositions in which the conductive phase is ruthenium based.

BACKGROUND OF THE INVENTION

Thick film materials are mixtures of metal, glass and/or ceramic powders dispersed in an organic vehicle. These materials are applied to nonconductive substrates to form conductive, resistive or insulating films. Thick film materials are used in a wide variety of electronic and light electrical components.

The properties of individual compositions depend on the specific constituents which comprise the compositions. All compositions contain three major components. The conductive phase determines the electrical properties and influences the mechanical properties of the final film. In conductor compositions, the conductive phase is generally a precious metal or mixture of precious metals. In resistor compositions the conductive phase is generally a metallic oxide. In dielectric compositions, the functional phase is generally a glass or ceramic.

The binder is usually a glass, a crystalline oxide or a combination of the two. The binder holds the film together and to the substrate. The binder also influences the mechanical properties of the final film.

The vehicle is a solution of polymers in organic solvents. The vehicle determines the application characteristics of the composition.

In the composition, the functional phase and binder are generally in powder form and have been thoroughly dispersed in the vehicle.

Thick film materials are applied to a substrate. The substrate serves as a support for the final film and may also have an electrical function, such as a capacitor dielectic. Substrate materials are generally nonconducting.

The most common substrate materials are ceramics. High-purity (generally 96%) aluminum oxide is the most widely used. For special applications, various titanate ceramics, mica, beryllium oxide and other substrates are used. These are generally used because of specific electrical or mechanical properties required for the application.

In some applications where the substrate must be transparent—such as displays—glass is used.

Thick film technology is defined as much by the processes as by the materials or applications. The basic thick film process steps are screen printing, drying and firing. The thick film composition is generally applied to the substrate by screen printing. Dipping, banding, brushing or spraying are occasionally used with irregular shaped substrates.

The screen printing process consists of forcing the thick film composition through a stencil screen onto the substrate with a squeegee. The open pattern in the stencil screen defines the pattern which will be printed onto the substrate.

After printing, the film is dried and fired—generally in air at a peak temperature of 500°-1000° C. This process forms a hard, adherent film with the desired electrical and mechanical properties.

Additional thick film compositions may be applied to the same substrate by repeating the screen printing, drying and firing processes. In this way, complex, interconnected conductive, resistive and insulating films can be generated.

Thick film resistor compositions are usually produced in decade resistance values and materials are available that provide a wide range of sheet resistance (0.5 Ω/□ to $1\times10^9$ Ω/□). A change in length to width aspect ratio of a resistor will provide resistance values lower than 0.5 Ω/□ and higher than $1\times10^9$ Ω/□ and any intermediate resistance value.

Composition blending is a technique widely used to obtain resistance value between standard decade values. Adjacent decade members can be mixed in all proportions to produce intermediate values of sheet resistance. The mixing procedure is simple but requires care and the proper equipment. Usually blending has minimal effect on Temperature Coefficient of Resistance.

High stability and low process sensitivity are critical requirements for thick film resistor compositions for microcircuit applications. In particular it is necessary that resistivity (R) of the films be stable over a wide range of temperature conditions. Thus, the Thermal Coefficient of Resistance (TCR) is a critical variable in any thick film resistor composition. Because thick film resistor compositions are comprised of a functional or conductive phase and a permanent binder phase, the properties of the conductive and binder phases and their interactions with each other and with the substrate affect both resistivity and TCR.

Functional phases based on ruthenium chemistry form the core of conventional thick film resistor compositions.

Ruthenium compounds based on the pyrochlore family have a cubic structure with each ruthenium atom surrounded by six oxygen atoms, forming an octahedron. Each oxygen atom is shared by one other octahedron to form a three-dimensional network of $Ru_2O_6$ stoichiometry. The open areas within this framework are occupied by large cations and additional anions. A wide range of substitution in this secondary lattice is possible which makes for a great deal of chemical flexibility. The pyrochlore structure with the general formula $A_2B_2O_{6-7}$ is such a flexible structure. Pyrochlores which behave as metals, semiconductors or insulators can be obtained through controlled substitution on available crystallographic sites. Many current pyrochlore based thick film resistors contain $Bi_2Ru_2O_7$ as the functional phase.

Ruthenium dioxide is also used as the conductive phase in thick film resistor compositions. Its rutile crystal structure is similar to that of pyrochlore in that each ruthenium atom is surrounded by six equidistant oxygen atoms forming an octohedron. However, in the rutile structure each oxygen is shared by 3 octahedra. This results in a complex three-dimensional network in which, in contrast to the case of pyrochlore, chemical substitution is very limited.

In the formulation of thick film resistor compositions for particular applications, it is often found that the TCR for the anticipated temperature range in use is too high and it therefore becomes necessary to increase or reduce the TCR in order that the resistivity not change too much over the operating range of temperature. It is well known in the thick film resistor art that additions of small amounts of various inorganic compounds will accomplish this. For example, in ruthenium-based resistors it is known to employ for this purpose CdO, $Nb_2O_5$, $TiO_2$, $MnO_2$, $Mn_2O_3$, $V_2O_5$, NiO, $Sb_2O_3$ and $Sb_2O_5$, all of which are negative TCR "drivers". That is, they reduce TCR. On the other hand, CuO is known as a positive TCR drive in ruthenium-based resistors.

In the usual formulation of resistors, it is found that negative TCR drivers lower TCR, but simultaneously raise resistivity (R). Conversely, positive TCR drivers raise TCR but lower resistivity.

A recurrent problem with the use of the prior art materials used as negative TCR drivers is that the resistivity of the resistors in which they are used is raised excessively when the desired level of TCR reduction is obtained. This is a disadvantage because it necessitates the inclusion of additional conductive phase metals to obtain the same resistivity level. In turn, the inclusion of additional conductive phase adversely affects the resistance stability of the fired resistor with respect to time.

BRIEF DESCRIPTION OF THE INVENTION

The disadvantages of prior art TCR drivers are overcome in ruthenium-based resistors by the use therein of a manganese vanadate TCR driver corresponding to the formula $$Mn_{n-x}M_xV_{2-y}M'_yO_{5+n+\Delta},$$

wherein M is a divalent metal cation having an ionic radius of 0.4 to 0.8;
M' is a metal cation having a valence of 4 to 6;
n is 1 to 2.
x is 0 to 0.5;
y is 0 to 0.5; and
Δ is varied to achieve electrical neutrality.

The invention is therefore directed to a resistor composition which is an admixture of finely divided particles of (a) ruthenium-based compound(s), (b) inorganic binder; and (c) a TCR driver as defined herein above dispersed in an appropriate organic medium.

In a second aspect the invention is directed to a resistor comprising a thin layer of the above-described dispersion which has been fired to remove the inert vehicle and to effect liquid phase sintering of the glass and then cooled.

DETAILED DESCRIPTION OF THE INVENTION

A. Ruthenium Component

The invention is directed to resistors in which the principal conductive phase is ruthenium based. At the present state of the art of ruthenium-based resistors, this is known to include $RuO_2$ and ruthenium compounds corresponding to the formula $$(M_cBi_{2-c})(M'_dRu_{2-d})O_{7-e},$$

wherein
M is at least one of the group consisting of yttrium, thallium, indium, cadmium, lead and the rare earth metals of atomic number 57–71, inclusive:
M' is at least one of platinum, titanium, chromium, rhodium and antimony;
c is a number in the range 0 to 2;
d is a number in the range 0 to about 0.5, that y is a number in the range 0 to 1 when M' is rhodium or more than one of platinum, and titanium; and
e is a number in the range 0 to 1, being at least equal to about x/2 when M is divalent lead or cadmium.

These compounds and their preparation are disclosed in U.S. Pat. No. 3,583,931 to Bouchard and also in German Patent Application OS 1,816,105.

The particle size of the above-described active materials is not narrowly critical from the standpoint of their technical effectiveness in the invention. However, they should, of course, be of a size appropriate to the manner in which they are applied, which is usually screen printing, and to the firing conditions. Thus the metallic material should be no bigger than 10 μm and preferably should be below about 5 μm. As a practical matter, the available particle size of the metals is as low as 0.1 μm. It is preferred that the ruthenium component have an average surface area of at least 5 $m^2/g$ and still more preferably at least 8 $m^2/g$.

Preferred ruthenium compounds include $BiPbRu_2O_{6.5}$, $Bi_{0.2}Pb_{1.8}Ru_2O_{6.1}$, $Bi_2Ru_2O_7$, $Pb_2Ru_2O_6$ and $RuO_2$. In addition, precursors of $RuO_2$, that is ruthenium compounds which upon firing will form $RuO_2$, are suitable for use in the invention, as are mixtures of any of these materials as well. Exemplary of suitable nonpyrochlore $RuO_2$ precursors are ruthenium metal, ruthenium resinates, $BaRuO_3$, $Ba_2RuO_4$, $CaRuO_3$, $Co_2RuO_4$, $LaRuO_3$, and $Li_2RuO_3$.

The composition may contain 4–75% wt. of the ruthenium-based component, it is preferred that it contain 10 to 60%.

B. Manganese Vanadate Component

Appropriate manganese vanadate compounds which can be used in the invention are those corresponding to the formula $$Mn_{n-x}M_xV_{2-y}M'_yO_{5+n+\Delta},$$

wherein M is a metal cation having an ionic radius of 0.4 to 0.8;
M' is a metal cation having a valence of 4 to 6;
n is 1 to 2
x is 0 to 0.5;
y is 0 to 0.5; and
Δ is varied to achieve electrical neutrality.

As used herein the term "ionic radius" refers to the values given by Shannon, R. D. and Prewitt, C. T., (1969), Acta Cryst., B25, 925, "Effective Ionic Radii in Oxides and Fluorides".

Preferred manganese vanadate compounds are those corresponding to the formula $Mn_aV_2O_b$ wherein a is from 1 to 2 and b is from 6 to 7. Primary examples of these materials are $Mn_2V_2O_7$ and $MnV_2O_6$, the latter of which occurs in two crystalline forms (alpha and beta).

The vanadate material will ordinarily be used at a concentration of from 0.05 to 15% by weight of the composition solids. However, 0.05 to 5% and especially 1 to 5% are preferred.

It is preferred that the manganese vanadate compounds have a high surface area since the material is more efficient in its function as a TCR driver when the surface area is high. A surface area of at least 0.5 $m^2/gm$ is preferred. Typically, the vanadate material used in the invention has had a surface area of about 0.8 $m^2/gm$.

The preferred manganese vanadates for use in the invention are made by reacting $MnCO_3$ with $V_2O_5$ in any of the following manners:

$$MnCO_3 + V_2O_5 \xrightarrow[\Delta]{Air} MnV_2O_6 + CO_2 \uparrow$$

-continued $$2MnCO_3 + V_2O_5 \xrightarrow[\Delta]{Air} MnV_2O_7 + 2CO_2 \uparrow$$

$$3MnCO_3 + V_2O_5 \xrightarrow[\Delta]{Air} MnV_2O_7 + \tfrac{1}{2}Mn_2O_3 + 3CO_2 \uparrow$$

In particular, finely divided particles of $MnCo_3$ and $V_2O_5$ are thoroughly mixed, either wet or dry, and the mixture is fired in air at a temperature of at least 500° C. until the reaction is completed as indicated by X-ray diffraction analysis of the reaction product. The reaction product is then size-reduced by any appropriate means such as ball milling to the size desired for formulation in the invention.

In a preferred method for making the above-described manganese vanadates, $MnCO_3$ and $V_2O_5$ powders are dry blended and fired in air at 650° C. for 16 hours. Upon cooling, the solid reaction product is ball milled so that the product will pass a 10 standard mesh screen and then again fired in air at 650° C. for 16 hours. Once more upon cooling, the solid product is ball milled to pass a 10 mesh screen and then rinsed with demineralized water and dried at 140° C. for 24 hours. The resultant product is very uniform in its physical properties.

As is the case for the ruthenate component of the invention, the particle size of the vanadate material is not narrowly critical, but should be of size appropriate to the manner in which the composition is applied.

C. Inorganic Binder

The glass frit used in the resistance material of the present invention may be of any well-known composition which has a melting temperature below that of the metal vanadate. The glass frits most preferably used are the borosilicate frits, such as lead borosilicate frit, bismuth, cadmium, barium, calcium or other alkaline earth borosilicate frits. The preparation of such glass frits is well-known and consists, for example, in melting together the constituents of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The glass is preferably milled in a ball-mill with water to reduce the particle size of the frit and to obtain a frit of substantially uniform size.

The glasses are prepared by conventional glass-making techniques, by mixing the desired components in the desired proportions and heating the mixture to form a melt. As is well-known in the art, heating is conducted to a peak temperature and for a time such that the melt becomes entirely liquid and homogeneous. In the present work, the components are premixed by shaking in a polyethylene jar with plastic balls and then melted in a platinum crucible at the desired temperature. The melt is heated at the peak temperature for a period of 1–1½ hours. The melt is then poured into cold water. The maximum temperature of the water during quenching is kept as low as possible by increasing the volume of water to melt ratio. The crude frit after separation from water, is freed from residual water by drying in air or by displacing the water by rinsing with methanol. The crude frit is then ball-milled for 3–5 hours in alumina containers using alumina balls. Alumina picked up by the materials, if any, is not within the observable limit as measured by X-ray diffraction analysis.

After discharging the milled frit slurry from the mill, the excess solvent is removed by decantation and the frit powder is air-dried at room temperature. The dried powder is then screened through a 325 mesh screen to remove any large particles.

The major two properties of the frit are: it aids the liquid phase sintering of the inorganic crystalline particulate matters; and form noncrystalline (amorphous) or crystalline materials by devitrification during the heating-cooling cycle (firing cycle) in the preparation of thick film resistors. This devitrification process can yield either a single crystalline phase having the same composition as the precursor noncrystalline (glassy) material or multiple crystalline phases with different compositions from that of the precursor glassy material.

D. Organic Medium

The inorganic particles are mixed with an essentially inert liquid medium (vehicle) by mechanical mixing (e.g., on a roll mill) to form a paste-like composition having suitable consistency and rheology for screen printing. The latter is printed as a "thick film" on conventional dielectric substrates in the conventional manner.

Any inert liquid may be used as the vehicle. Various organic liquids, with or without thickening and/or stabilizing agents and/or other common additives, may be used as the vehicle. Exemplary of organic liquids which can be used are the aliphatic alcohols, esters of such alcohols, for example, acetates and propionates, terpenes such as pine oil, terpineol and the like, solutions of resins such as the polymethacrylates of lower alcohols, and solutions of ethyl cellulose in solvents such as pine oil, and the monobutyl ether of ethylene glycol monoacetate. A preferred vehicle is based on ethyl cellulose and beta terpineol. The vehicle may contain volatile liquids to promote fast setting after application to the substrate.

The ratio of vehicle to solids in the dispersions can vary considerably and depends upon the manner in which the dispersion is to be applied and the kind of vehicle used. Normally to achieve good coverage the dispersions will contain complementally, 60–90% solids and 40–10% vehicle. The compositions of the present invention may, of course, be modified by the addition of other materials which do not affect its beneficial characteristics. Such formulation is well within the skill of the art.

The pastes are conveniently prepared on a three-roll mill. The viscosity of the pastes is typically within the following ranges when measured on a Brookfield HBT viscometer at low, moderate and high shear rates:

| Shear Rate ($Sec^{-1}$) | Viscosity (Pa.S) | |
|---|---|---|
| 0.2 | 100–5000 | — |
| | 300–2000 | Preferred |
| | 600–1500 | Most preferred |
| 4 | 40–400 | — |
| | 100–250 | Preferred |
| | 140–200 | Most preferred |
| 384 | 7–40 | — |
| | 10–25 | Preferred |

-continued

| Shear Rate ($Sec^{-1}$) | Viscosity (Pa.S) | |
|---|---|---|
| | 12–18 | Most preferred |

The amount of vehicle utilized is determined by the final desired formulation viscosity.

Formulation and Application

In the preparation of the composition of the present invention, the particulate inorganic solids are mixed with the organic carrier and dispersed with suitable equipment, such as a three-roll mill, to form a suspension, resulting in a composition for which the viscosity will be in the range of about 100–150 pascal-seconds at a shear rate of 4 $sec^{-1}$.

In the examples which follow, the formulation was carried out in the following manner:

The ingredients of the paste, minus about 5% organic components equivalent to about 5% wt., are weighed together in a container. The components are then vigorously mixed to form a uniform blend; then the blend is passed through dispersing equipment, such as a three roll mill, to achieve a good dispersion of particles. A Hegman gauge is used to determine the state of dispersion of the particles in the paste. This instrument consists of a channel in a block of steel that is 25 μm deep (1 mil) on one end and ramps up to 0" depth at the other end. A blade is used to draw down paste along the length of the channel. Scratches will appear in the channel where the agglomerates' diameter is greater than the channel depth. A satisfactory dispersion will give a fourth scratch point of 10–18 μm typically. The point at which half of the channel is uncovered with a well dispersed paste is between 3 and 8 μm typically. Fourth scratch measurement of >20 μm and "half-channel" measurements of >10 μm indicate a poorly dispersed suspension.

The remaining 5% consisting of organic components of the paste is then added, and the resin content is adjusted to bring the viscosity when fully formulated to between 140 and 200 Pa.s at a shear rate of 4 $sec^{-1}$.

The composition is then applied to a substrate, such as alumina ceramic, usually by the process of screen printing, to a wet thickness of about 30–80 microns, preferably 35–70 microns, and most preferably 40–50 microns. The electrode compositions of this invention can be printed onto the substrates either by using an automatic printer or a hand printer in the conventional manner. Preferably automatic screen stencil techniques are employed using a 200 to 325 mesh screen. The printed pattern is then dried at below 200° C., e.g., about 150° C., for about 5–15 minutes before firing. Firing to effect sintering of both the inorganic binder and the finely divided particles of metal is preferably done in a well ventilated belt conveyor furnace with a temperature profile that will allow burnout of the organic matter at about 300°–600° C., a period of maximum temperature of about 800°–950° C. lasting about 5–15 minutes, followed by a controlled cooldown cycle to prevent over-sintering, unwanted chemical reactions at intermediate temperatures, or substrate fracture which can occur from too rapid cooldown. The overall firing procedure will preferably extend over a period of about 1 hour, with 20–25 minutes to reach the firing temperature, about 10 minutes at the firing temperature, and about 20–25 minutes in cooldown. In some instances total cycle times as short as 30 minutes can be used.

Sample Preparation

Samples to be tested for Temperature Coefficient of Resistance (TCR) are prepared as follows:

A pattern of the resistor formulation to be tested is screen printed upon each of ten coded Alsimag 614 1×1" ceramic substances, and allowed to equilibrate at room temperature and then dried at 150° C. The mean thickness of each set of dried films before firing must be 22–28 microns as measured by a Brush Surfanalyzer. The dried and printed substrate is then fired for about 60 minutes using a cycle of heating at 35° C. per minute to 850° C., dwell at 850° C. for 9 to 10 minutes and cooled at a rate of 30° C. per minute to ambient temperature.

Resistance Measurement and Calculations

The test substrates are mounted on terminal posts within a controlled temperature chamber and electrically connected to a digital ohm-meter. The temperature in the chamber is adjusted to 25° C. and allowed to equilibrate, after which the resistance of each substrate is measured and recorded.

The temperature of the chamber is then raised to 125° C. and allowed to equilibrate, after which the resistance of the substrate is again measured and recorded.

The temperature of the chamber is then cooled to −55° C. and allowed to equilibrate and the cold resistance measured and recorded.

The hot and cold temperature coefficients of resistance (TCR) are calculated as follows:

$$\text{Hot } TCR = \frac{R_{125^\circ C.} - R_{25^\circ C.}}{R_{25^\circ C.}} \times (10{,}000) \text{ ppm/°C.}$$

$$\text{Cold } TCR = \frac{R_{-55^\circ C.} - R_{25^\circ C.}}{R_{25^\circ C.}} \times (-12{,}500) \text{ ppm/°C.}$$

The values of $R_{25^\circ C.}$ and Hot and Cold TCR are averaged and $R_{25^\circ C.}$ values are normalized to 25 microns dry printed thickness and resistivity is reported as ohms per square at 25 microns dry print thickness. Normalization of the multiple test values is calculated with the following relationship:

$$\text{Normalized Resistance} = \frac{\left(\text{Avg. measured resistance}\right) \times \left(\text{Avg. dry print thickness, microns}\right)}{25 \text{ microns}}$$

Laser Trim Stability

Laser trimming of thick film resistors is an important technique for the production of hybrid microelectronic circuits. [A discussion can be found in *Thick Film Hybrid Microcircuit Technology* by D. W. Hamer and J. V. Biggers (Wiley, 1972) p. 173ff.] Its use can be understood by considering that the resistances of a particular resistor, printed with the same resistive ink on a group of substrates, have a Gaussian-like distribution. To make all the resistors have the same design value for proper circuit performance, a laser is used to trim resistances up by removing (vaporizing) a small portion of the resistor material. The stability of the trimmed resistor is then a measure of the fractional change (drift) in resistance that occurs after laser trimming. Low resistance drift-high stability—is necessary so that the resistance remains close to its design value for proper circuit performance.

EXAMPLES

EXAMPLE 1

A manganese vanadate corresponding to the formula $MnV_2O_6$ was made by the following procedure:

Dry $V_2O_5$ and $MnCO_3$ powders in the stochiometric proportions of $MnV_2O_6$ were ground with an agate mortar and pestle and admixed by shaking. The admixed powders were placed in a platinum crucible and heated in an oven for 14 hours at 620° C. The thusly heated material was removed and then ball milled with an equal weight of distilled water. The ground material was dried in an oven at 140° C., screened and dry mixed by shaking. The dried admixture was again placed in a platinum crucible and oven heated for 16 more hours at 620° C. Upon removal from the oven, the admixture was crushed to remove any agglomerates and again placed in a platinum crucible and fired for 26 hours at 620° C. The material was then allowed to cool slowly, after which it was ball-milled with an equal weight of water.

EXAMPLE 2

A second manganese vanadate corresponding to the formula $MnV_2O_6$ was made by the following procedure:

Dry $V_2O_5$ and $MnCO_3$ powders in the stoichiometric proportions of $MnV_2O_6$ were admixed by slurrying the powders in distilled water. The slurry was dried at 170° C. for 2 hours. The dried admixture was placed in a platinum crucible and heated at 620° C. for 10 minutes, removed from the oven and cooled by quenching in air. After grinding with a mortar and pestle it was placed back in the platinum crucible and heated for 20 hours at 620° C., after which it was cooled and examined by X-ray diffraction. The material was then heated an additional 20 hours at 620° C. and quenched in air. Upon examination by X-ray diffraction, no change was observed thus indicating a single phase material.

EXAMPLE 3

A further quantity of manganese vanadate corresponding to the formula $MnV_2O_7$ was made by the following procedure:

A. Dry $V_2O_5$ and $MnCO_3$ powders in the stoichiometric proportions of $MnV_2O_7$ were admixed by dry grinding with mortar and pestle, placed in a platinum crucible and preheated in an oven at 620° C. for 1 hour. The cooled material was reground with mortar and pestle and returned to the oven at 620° C. for 67 hours. At that time it was ground once again with mortar and pestle and examined by X-ray diffraction. A single phase of $MnV_2O_7$ was obtained.

B. Using the procedure of A. immediately above, $MnCo_3$ and $V_2O_5$ in the stoichiometric proportions of $Mn_3V_2O_8$ were additionally subjected to 4 hours of heating at 740° C. and examined by X-ray diffraction. No single phase material was detected.

EXAMPLES 4–8

A series of thick film ruthenium-based resistors was formulated in the manner described hereinabove in which manganese vanadates of different origin were used as the TCR driver. Each of the resistors was tested as to resistance and Hot TCR in the manner described hereinabove. The inorganic binder component of this series of resistors had the composition 65% wt. PbO, 34% wt. $SiO_2$ and 1% wt. $Al_2O_3$. The data for these tests indicate that all of the manganese vanadates were strongly negative TCR drivers at elevated temperatures.

TABLE 1

| | Effectiveness of $Mn_{1-2}V_2O_{6-7}$ As TCR Drivers at 125° C. | | | | |
|---|---|---|---|---|---|
| Example No. | 4 | 5 | 6 | 7 | 8 |
| Component | (% wt.) | | | | |
| $Bi_2Ru_2O_7$ | 30.0 | 30.0 | 30.0 | 30.0 | 30.0 |
| Binder | 39.0 | 39.0 | 39.0 | 39.0 | 39.0 |
| $MnV_2O_6$(1) | 1.0 | — | — | — | — |
| $MnV_2O_6$(2) | — | 1.0 | — | — | — |
| $MnV_2O_6$(3) | — | — | 1.0 | — | — |
| $MnV_2O_7$(4) | — | — | — | 1.0 | — |
| $MnV_2O_7$ + $Mn_2O_3$(5) | — | — | — | — | 1.0 |
| Organic(6) Medium | 30.0 | 30.0 | 30.0 | 30.0 | 30.0 |
| R Avg. (Ω/□) | 740.7 | 926.6 | 536.0 | 956.0 | 896.8 |
| HTCR (ppm/°C.) | −256 | −334 | −188 | −423 | −410 |

(1)Made by procedure of Example 1, surface area 0.79 $m_2/g$.
(2)99.9% wt. $MnV_2O_6$ purchased from Cerac, Inc., Milwaukee, WI 53233, surface area 0.42 $m_2/g$.
(3)Made by procedure of Example 2, surface area not measured.
(4)Made by procedure of Example 3A, surface area not measurerd. Mole ratio of $MnCO_3$ to $V_2O_5$ 2:1.
(5)Made by procedure of Example 3B, surface area not measured. Mole ratio of $MnCO_3$ to $V_2O_5$ 3:1.
(6)Organic medium was solution of ethyl cellulose, mixed α and β terpineol, butyl carbitol and 0.2% wt. stabilizers.

EXAMPLES 9–15

A further series of resistors was prepared in which the TCR driving action of $MnV_2O_6$ was compared with several known prior-art TCR drivers including $MnO_2$ and $V_2O_5$ and mixtures thereof. The inorganic binder and organic medium components of the pastes from which the resistors were prepared were the same as in Examples 4–8. The composition of the resistors, their resistance and HTCR properties are given in Table 2 below.

TABLE 2

| | | Comparison of $MnV_2O_{6-7}$ With Prior Art TCR Drivers | | | | | | |
|---|---|---|---|---|---|---|---|---|
| Example No. | Control | 9 | 10 | 11 | 12 | 13 | 14 | 15 |
| Component | (% wt.) | | | | | | | |
| $Bi_2Ru_2O_7$ | 30.0 | 30.0 | 30.0 | 30.0 | 30.0 | 30.0 | 30.0 | 30.0 |
| Binder | 39.0 | 39.0 | 39.0 | 39.0 | 39.0 | 39.0 | 39.0 | 39.0 |
| $MnV_2O_6$ | — | 1.0 | — | — | — | — | — | — |
| $MnO_2$ | — | — | 1.0 | 0.25 | — | — | — | — |
| $V_2O_5$ | — | — | | 0.75 | 1.0 | — | — | — |
| $Nb_2O_5$ | — | — | — | — | — | 1.0 | — | — |
| $Sb_2O_3$ | — | — | — | — | — | — | 1.0 | — |
| $TiO_2$ | — | — | — | — | — | — | — | 1.0 |
| Organic Medium | 31.0 | 30.0 | 30.0 | 30.0 | 30.0 | 30.0 | 30.0 | 30.0 |

TABLE 2-continued

| Comparison of $MnV_2O_{6-7}$ With Prior Art TCR Drivers | | | | | | | | |
|---|---|---|---|---|---|---|---|---|
| Example No. Component | Control | 9 | 10 | 11 | 12 | 13 | 14 | 15 |
| | | | | (% wt.) | | | | |
| R avg. (Ω/□) | 871.3 | 926.6 | 2239.8 | 603.3 | 872.6 | 3276.6 | 1049.4 | 114,400 |
| HTCR (ppm/°C.) | +145 | −334 | −466 | −174 | +34 | −532 | +49 | 1,283 |

The above data show quite graphically that while prior art compounds are generally strongly negative TCR drivers above room temperature, they perform this function with considerable sacrifice of resistance. That is, the resistance is raised substantially by the inclusion of the TCR driver. On the other hand, the $MnV_2O_6$ material of the invention was effective to reduce HTCR to below 300 ppm/°C. with only 6% increase in resistance. It is interesting to note that the capability of $MnV_2O_6$ to reduce HTCR without substantial increase in resistivity was markedly superior to either of its precursors, i.e., $MnO_2$ or $V_2O_5$. Thus while $MnO_2$ was an effective TCR driver, it raised the resistivity by 157%. On the other hand, $V_2O_5$ was not effective here as a negative TCR driver and had essentially no effect on resistivity at all. Interestingly, the mixtures of the $MnO_2$ and $V_2O_5$ produced an HTCR intermediate to the HTCR values of the individual materials. However, the resistivity of the $MnO_2/V_2O_5$ mixture was lower than that of either of the separate components.

EXAMPLES 16 AND 17

Two resistors having quite low resistivity were prepared in which the ruthenium-based component was $RuO_2$ and $MnV_2O_6$ was the manganese vanadate. In this instance the glass composition was 49.4% PbO, 24.8% $SiO_2$, 13.9% $B_2O_3$, 7.9% $MnO_2$ and 4.0% $Al_2O_3$. The composition and electrical properties of these two resistors are compared with a control composition containing no manganese vanadate in Table 3, which follows:

TABLE 3

| Use of Manganese Vanadate as TCR Driver for Low Resistivity Compositions | | | |
|---|---|---|---|
| Example No. Component | Control | 16 | 17 |
| | | (% wt.) | |
| $RuO_2$ | 37.5 | 37.2 | 37.0 |
| Binder | 37.5 | 37.2 | 37.0 |
| $MnV_2O_6$ | — | 0.6 | 1.0 |
| Organic Medium | 25.0 | 25.0 | 25.0 |
| R avg. (Ω/□) | 10.6 | 13.0 | 17.0 |
| HTCR (ppm/°C.) | ca. +175 | −132 | −296 |

The above data again show the effect of $MnV_2O_6$ as a negative TCR driver without unduly raising the resistivity of the formulation when $RuO_2$ rather than pyrochlore is used as the ruthenium-based component.

EXAMPLES 18–21

A further series of low resistivity resistors was prepared in which the active metal phase consisted of both $RuO_2$ and silver oxide ($Ag_2O$) and the manganese vanadate was $MnV_2O_6$. The glass binder component contained on a weight basis 55.9% PbO, 28.0% $SiO_2$, 8.1% $B_2O_3$, 4.7% $Al_2O_3$, and 3.3% $TiO_2$. In this series of resistors, the amount of the manganese vanadate TCR driver was varied to observe the effect of its concentration upon the electrical properties of the resistors. The data for this series of tests, which are given in Table 4 below, show that the small extent to which resistivity is raised by the TCR driver of the invention goes through a maximum at about 5% by weight. The greatest negative TCR driving power appears to be at about the same concentration.

TABLE 4

| Effect of Concentration of Manganese Vanadate TCR Driver on Driving Capability and Resistance | | | | | |
|---|---|---|---|---|---|
| Example No. Component | Control | 18 | 19 | 20 | 21 |
| | | | (% wt.) | | |
| Ru $O_2$ | 50 | 50 | 50 | 50 | 50 |
| $Ag_2O$ | 20 | 20 | 20 | 20 | 20 |
| Binder | 30 | 25 | 20 | 15 | 13 |
| $MnV_2O_6$ | — | 5 | 10 | 15 | 17 |
| Organic Medium | | | To Viscosity | | |
| R avg (Ω/□) | 12.2 | 31.3 | 18.5 | 14.8 | 13.3 |
| HTCR (ppm/°C.) | +777 | −210 | −70 | −147 | −133 |

EXAMPLES 22–25

A further series of resistors having somewhat higher resistivity was formulated in which the active metal phase consisted of both $RuO_2$ and silver oxide ($Ag_2O$) and the manganese vanadate TCR driver was $MnV_2O_6$. The glass binder component on a weight basis consisted of 49.4% PbO, 24.8% $SiO_2$, 13.9% $B_2O_3$, 7.9% $MnCO_2$, 4.0% $Al_2O_3$. In this series of tests the amount of $MnV_2O_6$ was varied from 19 to 41% by weight and correspondingly the amount of glass was varied from 22% to zero. The data from this series, which are given in Table 5 below, illustrate that the negative TCR driving capability of the vanadate varies inversely with the amount of inorganic binder when the active conductive phase remains unchanged.

TABLE 5

| Effect of Reducing Binder and Increasing TCR Driver on Resist Properties | | | | | |
|---|---|---|---|---|---|
| Example No. Component | 22 | 23 | 24 | 25 | 26 |
| | | | (% wt.) | | |
| $RuO_2$ | 44 | 44 | 44 | 44 | 44 |
| $Ag_2O$ | 15 | 15 | 15 | 15 | 15 |
| Binder | 22 | 18 | 12 | 6 | — |
| $MnV_2O_6$ | 19 | 23 | 29 | 35 | 41 |
| Organic Medium | Balance | Balance to viscosity | Balance | Balance | Balance |
| R avg. (Ω/□) | 25.3 | 17.7 | 23.3 | 28.0 | 40.9 |
| HTCR (ppm/°C.) | +117 | +90 | +39 | −38 | −278 |

EXAMPLES 26 TO 29

Another series of resistors was prepared using equal parts by weight $RuO_2$ as the active conductive phase and glass as the binder component. The TCR driver was $MnV_2O_6$. In this series of tests, the 48-hour laser trim stability (LTS) of the resistors prepared therefrom was measured. The data for this series show that at very high concentrations, the $MnV_2O_6$ becomes less effective as a negative TCR driver and post-laser trim resistance drift increases as well. These data are given in Table 6 which follows:

TABLE 6

Effect of Manganese Vanadate Concentration Upon Resistor Laser Trim Stability

| Example No. | Control | 26 | 27 | 28 | 29 |
|---|---|---|---|---|---|
| Component | | | (parts by wt.) | | |
| $RuO_2$/glass | 100 | 99 | 97 | 90 | 70 |
| $MnV_2O_6$ | — | 1 | 3 | 10 | 30 |
| Organic medium | | | To Viscosity | | |
| R avg. (Ω/□) | 25 | 32 | 53 | 61 | 66 |
| HTCR (ppm/°C.) | −52 | −199 | −507 | −351 | +82 |
| LTS (%) | 0.43 | 0.56 | 0.91 | 1.16 | 3.31 |

I claim:

1. A resistor composition consisting essentially of an admixture of finely divided particles of (a) 4–75% wt. ruthenium oxide-based conductive materials; (b) 96–25% wt. nonconductive glass; and (c) 0.05–15% wt. of a manganese vanadate compound corresponding to the formula:

$$Mn_{n-x}M_xV_{2-y}M'_yO_{5+n+\Delta},$$

wherein M is a metal cation having an ionic radius of 0.4 to 0.8;

M' is a metal cation having a valence of 4 to 6;

n is 1 to 2 x is 0 to 0.5;

y is 0 to 0.5; and

Δ is varied to achieve electrical neutrality, the admixture being dispersed in an organic medium.

2. The composition of claim 1 in which the manganese vanadate corresponds to the formula $Mn_aV_2O_b$, in which a is from 1 to 2 and b is from 6 to 7.

3. The composition of claim 2 in which the manganese vanadate is $MnV_2O_6$ in either alpha or beta form or mixtures thereof.

4. The composition of claim 2 in which the manganese vanadate is $MnV_2O_7$.

5. The composition of claim 1 in which the ruthenium oxide-based conductive material is selected from the group consisting of $RuO_2$, compounds corresponding to the formula $$Bi_{2-c}M_c(Ru_{2-d}M'_d)O_{7-e})$$

and mixtures thereof, wherein

M is at least one of the group consisting of yttrium, thallium, indium, cadmium, lead and the rare earth metals of atomic number 57–71, inclusive:

M' is at least one of platinum, titanium, chromium, rhodium and antimony;

c is a number in the range 0 to 2;

d is a number in the range 0 to about 0.5, that y is a number in the range 0 to 1 when M' is rhodium or more than one of platinum, and titanium; and e is a number in the range 0 to 1, being at least equal to about x/2 when M is divalent lead or cadmium.

6. The composition of claim 5 in which the conductor material is $Bi_2Ru_2O_7$.

7. The composition of claim 5 in which the conductor material is $BiPbRu_2O_{6.5}$.

8. The composition of claim 5 in which the conductor material is $Bi_{0.2}Pb_{1.8}Ru_2O_{6.1}$.

9. The composition of claim 5 in which the conductor material is $Pb_2Ru_2O_6$.

10. A resistor comprising a thin layer of the dispersion of claim 1 which has been fired in air at a maximum temperature of 950° C. to volatilize the organic medium and to effect liquid phase sintering of the glass.

11. The method of forming a resistor comprising (a) forming a patterned thin layer of the dispersion of claim 1, (b) drying the layer and (c) firing the dried layer in air at a maximum temperature of 950° C. to effect volatilization of the organic medium and to effect liquid phase sintering of the glass.

* * * * *